US005679192A

United States Patent [19]

McHugh

[11] Patent Number: 5,679,192

[45] Date of Patent: Oct. 21, 1997

[54] PROCESS FOR THE MANUFACTURE OF ELECTRIC CABLES

[75] Inventor: Marcus David McHugh, Carmel, Ind.

[73] Assignee: BICC Public Limited Company, London, England

[21] Appl. No.: 398,517

[22] Filed: Mar. 3, 1995

[30] Foreign Application Priority Data

Mar. 7, 1994 [GB] United Kingdom ..... 9404390

[51] Int. Cl.[6] ..... H01B 3/30

[52] U.S. Cl. ..... 156/143; 156/272.2; 156/275.5; 427/118; 427/350; 427/487

[58] Field of Search ..... 156/143, 272.2, 156/275.5; 427/118, 350, 487

[56] References Cited

U.S. PATENT DOCUMENTS

| | | | |
|---|---|---|---|
| 3,911,192 | 10/1975 | Aronoff | 428/379 |
| 4,060,659 | 11/1977 | Matsubara et al. | 428/379 |
| 4,109,098 | 8/1978 | Olsson et al. | 174/106 SC |
| 4,332,716 | 6/1982 | Shah | 521/137 |
| 5,327,513 | 7/1994 | Nguyen et al. | 385/114 |

OTHER PUBLICATIONS

Webster's II New Riverside University Dictionary, The Riverside Publishing Company, pp. 1055 & 1249.

*Primary Examiner*—Kathleen Choi
*Attorney, Agent, or Firm*—Oliff & Berridge

[57] ABSTRACT

Electric cables with sector-shaped conductors, for maximizing duct capacity, are made by a process in which the shaped metallic conductor is first preformed into a helical twisted form ("pre-spiralled"), next covered with insulation of EPR, polyethylene or other suitable insulation material to form a core, third subjected to ionizing radiation to crosslink the insulation, and fourth laid up with other like cores to form a cable. All the steps are well known yet the potential to apply radiation crosslinking to this type of cable—in which other crosslinking techniques are wholly impracticable—has not hitherto been appreciated.

16 Claims, 1 Drawing Sheet

PROCESS FOR THE MANUFACTURE OF ELECTRIC CABLES

BACKGROUND OF THE INVENTION

1. Field of the Invention

This invention relates to a process for the manufacture of electric cables of a compact design with a plurality (usually from three to six) of sector-shaped conductors each insulated with EPR (that is ethylene/propylene copolymer or ethylene/propylene/diene terpolymer elastomer), crosslinked polyethylene or other suitable crosslinked polymeric material and of cores (insulated conductors) for such cables. It includes cables and cores made by the process.

2. Description of Related Art

It has long been the practice in making impregnated-paper insulated and thermoplastic-insulated cables with sector-shaped conductors, except in the smallest sizes, to "prespiral" the metallic conductors, prior to the application of the paper insulation: that is to twist them with a pitch substantially equal to the lay length of the cable to be formed. This facilitates the laying-up operation, because the large forces needed to twist a metal body of significant cross-section do not have to be transmitted to it through the relatively weak and relatively sensitive insulating material subsequently applied to it, and there is consequently less risk of damage and a tighter laying up can be achieved, resulting in a small yet useful reduction in diameter. It is plainly desirable to extend this prespiralling technique to cables with crosslinked polymeric insulation (usually of EPR or crosslinked polyethylene).

In Europe, this extension has been achieved by the use of a crosslinking technique in which silane side-chains are first grafted to the polymer—usually polyethylene—(or alternatively are introduced into the polymer ab initio by copolymerisation) and in a subsequent step crosslinking is achieved by a catalysed hydrolytic condensation reaction between pairs of silane side-chains. However, this crosslinking technique produces a crosslinked product with a slightly higher power factor and slightly less favorable electrical properties generally than conventional crosslinking techniques, and the North American market has not been prepared to tolerate what it perceives as a degradation of product quality. Conventional crosslinking by continuous techniques using pressurized steam is virtually impossible because of the need to maintain a high-pressure seal around a rotating non-circular body without imposing substantial forces on it, and unconventional techniques such as the use of long heated dies, molten salt baths and batch curing are unworkable or prohibitively expensive, and the result has been that cables with prespiralled conductors and crosslinked polymeric insulation have not been available to meet North American requirements.

With the benefit of the contribution of the present inventor, it becomes surprising that this is so, since the means of overcoming the problem is well-known and has been in regular use in North America and elsewhere for the manufacture of low voltage cables for many years.

SUMMARY OF THE INVENTION

In accordance with the invention, a process for the manufacture of an electric cable comprises (1) preforming a shaped metallic conductor into a helical twisted form;

(2) covering the so preformed metallic conductor with insulation of crosslinkable polymeric material;

(3) subjecting said polymeric material on the conductor to ionizing radiation to crosslink it and so form a prespiralled cable core with crosslinked polymeric insulation; and then (4) laying up said cable core with other like cores to form a cable.

Naturally, the first three steps produce a core in accordance with the invention.

The first two steps may be entirely conventional, except only that the selection and formulation of the polymeric material for the insulation may be influenced by the need to optimise response to the type of irradiation to be used. In some cases, the polymeric material may include a polyunsaturated radiation sensitiser (such as triallylisocyanurate, TAIC).

The cable may also include semiconducting screening layers under and/or over the insulation, and these may also (but need not in all cases) be crosslinked by the exposure to ionizing radiation.

Since the insulation (and semiconducting screens) do not need to contain peroxides or like crosslinking agents, it becomes feasible to filter the polymeric material much more effectively for the elimination of particulate impurities. Conventional cable-making compositions with dicumyl peroxide, or other conventional peroxide crosslinking agents, cannot be passed through wire mesh filters finer than about 100 mesh without significant risk of "scorch" attributable to the shear and/or catalytic effects at the mesh inducing premature decomposition of the peroxide. Insulation compositions suitable for electron-beam crosslinking in the practice of the present invention, on the other hand, can be filtered through 700-mesh wire filters without risk, and semiconducting ones through about 400 mesh (the limit depending, to some extent, on the grade of conductive black used).

The step of exposing the conductor to ionizing radiation is also in itself conventional, and any of the irradiation processes used for other wires and cables may be adopted. However, because the metallic conductor has a powerful screening effect against useful forms of radiation, there are major advantages in choosing an electron-beam irradiation process (or at least a process in which a particle accelerator, rather than a radioisotope, is used no generate ionising radiation). Adequate circumferential coverage and uniformity can be achieved either by using (say) three beams distributed around the circumference of the advancing cable core, or by rotating the cable core at an appropriate rate as it passes under a single beam.

Laying up may also be entirely conventional, and may be followed by the application of any conventional kind of jacket and/or armor that may be desired.

BRIEF DESCRIPTION OF THE DRAWINGS

The invention will be further described, by way of example, with reference to the accompanying drawings in which.

DESCRIPTION OF THE PREFERRED EMBODIMENT

Figure 1:
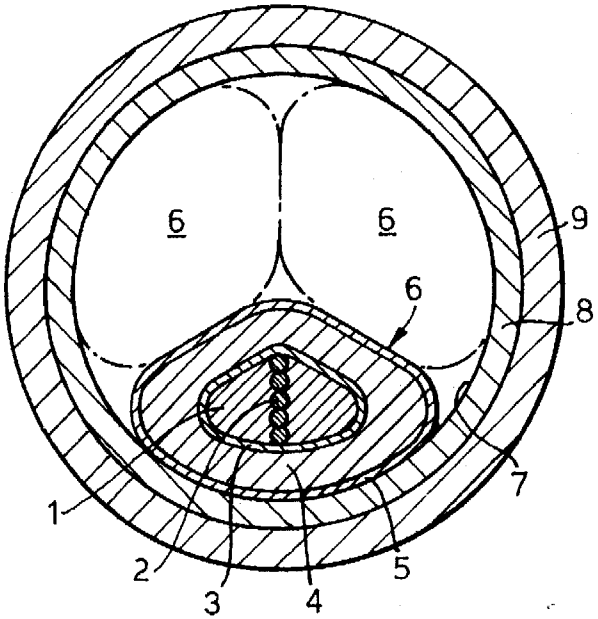
FIG. 1 is a diagrammatic cross-section of a cable in accordance with the invention.
Figure 2:
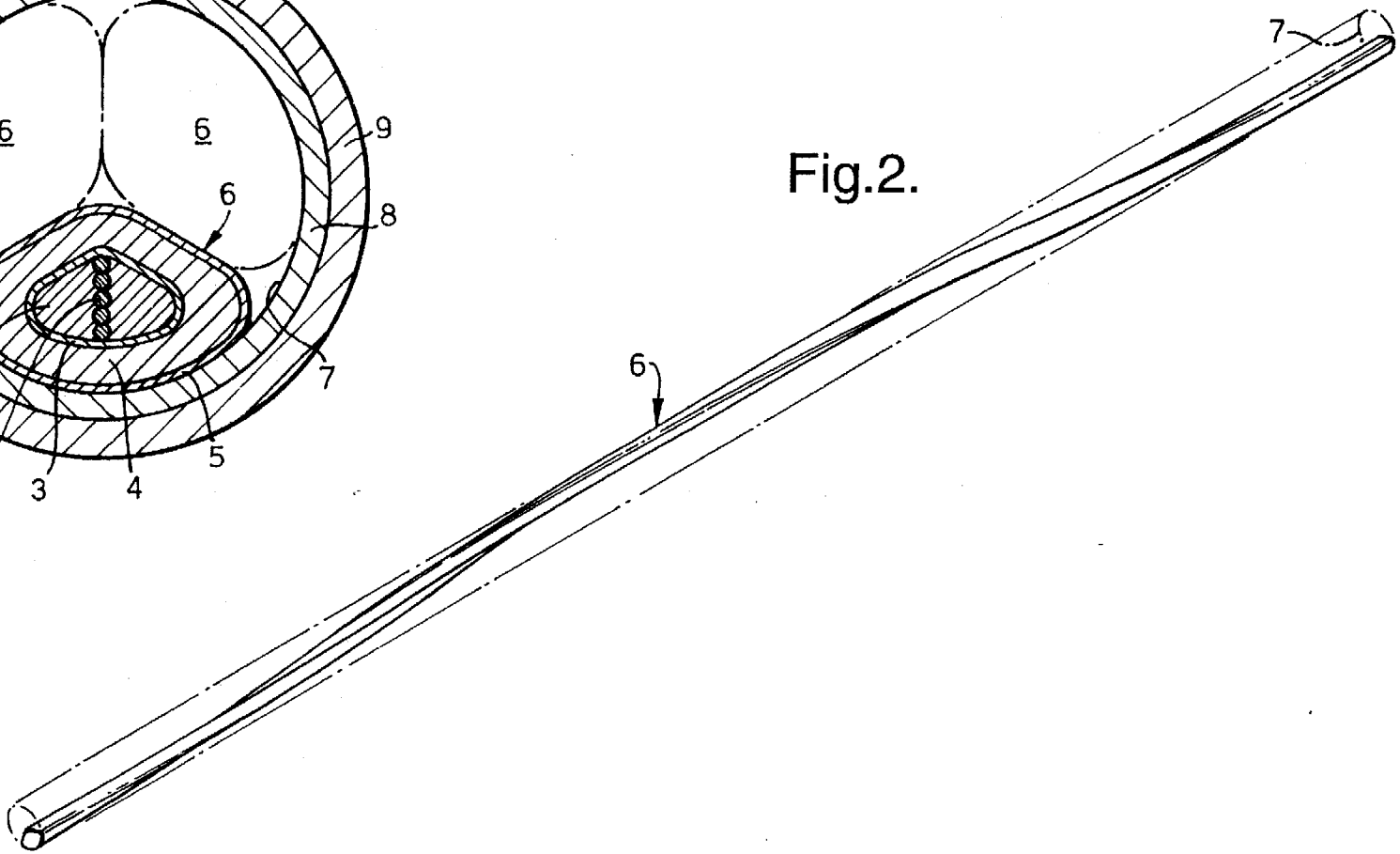
FIG. 2 is a perspective view of a portion of a core for the cable of FIG. 1.

A conventional 750MCM (375 mm2) 120° sector-shaped conductor 1 made up of 91 aluminum wires 2 each of 0.0991 inches (2.5 mm) diameter is prespiralled to a pitch of 72 inches (1.8 m). A triple extrusion head is used to apply in a single operation a conductor screen 3, insulating polymeric insulation material 4 and a core screen 5 to form a core indicated as a whole by the reference numeral 6. The insulation material is, in this case, of a conventional EPR formulation in which the antioxidant is 1.5% of the proprietory material sold under the trademark AGERITE as Agerite MA and forms a layer with a nominal radial thickness of 0.175 inch (4.4 mm). The screens 3 and 5 are of conventional semiconducting carbon-loaded formulations based on an ethylene/ethyl acrylate copolymer and an ethylene/vinyl acetate copolymer respectively.

The core is now passed under the beam of an RDI electrocurtain accelerator at a speed in the range 20–60 feet per minute (0.1–0.3 m/s); the beam is approximately 6 feet (1.8 m) wide and the core is rotated about its own axis at a rate to achieve two full rotations in the beam, while the beam energy is adjusted as required to maintain the intensity needed to achieve a dose of about 12 MRad throughout the polymeric part of the core. Rotating lead seals are used to allow the sector-shaped core to enter and leave the vault of the accelerator without radiation hazard.

Three cores 6,6,6 made in this way are laid up together using a planetary stranding machine to complete the essential components of a cable, with a circumscribing circle 7 of 2.8 inch (71 mm) diameter. The corresponding diameter for an otherwise similar cable formed without prespiralling would be about 3.0 inches (76 mm), and it would be very difficult to lay up without damaging the polymeric layers.

A binder tape 8 and a polyethylene jacket 9 with a radial thickness of 0.1 inch (2.5 mm) constitute one suitable way of providing mechanical protection and sealing against water and other fluids.

What I claim as my invention is:

1. A process for the manufacture of an electric cable comprising (1) preforming each of a plurality of sector-shaped metallic conductors into a helical twisted form;

(2) covering each of said preformed metallic conductors with insulation of crosslinkable polymeric material;

(3) subjecting said polymeric material on the conductors to ionizing radiation to crosslink the polymeric material and so make crosslinked polymer insulated prespiralled cable cores comprising the preformed metallic conductors; and then (4) laying up said crosslinked polymer insulated prespiralled cable cores to make a cable.

2. A process in accordance with claim 1 comprising including a polyunsaturated radiation sensitiser in the said polymeric material.

3. A process in accordance with claim 1 comprising forming a semiconducting screening layer under said insulation.

4. A process in accordance with claim 3 in which the said screening layer also is crosslinked by the said exposure to ionizing radiation.

5. A process in accordance with claim 1 comprising forming a semiconducting screening layer over said insulation.

6. A process in accordance with claim 5 in which the said screening layer also is crosslinked by the said exposure to ionizing radiation.

7. A process in accordance with claim 1 comprising filtering said polymeric material through a wire screen of about 700 mesh.

8. A process in accordance with claim 1 in which said ionizing radiation is an electron beam from at least one accelerator.

9. A process for the manufacture of an electric cable core comprising (1) preforming a sector-shaped metallic conductor into a helical twisted form;

(2) covering the so preformed metallic conductor with insulation of crosslinkable polymeric material; and (3) subjecting said polymeric material on the conductor to ionizing radiation to crosslink the polymeric material and so make a prespiralled cable core comprising the preformed metallic conductor covered with crosslinked polymeric insulation.

10. A process in accordance with claim 9 comprising including a polyunsaturated radiation sensitiser in the said polymeric material.

11. A process in accordance with claim 9 comprising forming a semiconducting screening layer under said insulation.

12. A process in accordance with claim 11 in which the said screening layer also is crosslinked by the said exposure to ionizing radiation.

13. A process in accordance with claim 9 comprising forming a semiconducting screening layer over said insulation.

14. A process in accordance with claim 13 in which the said screening layer also is crosslinked by the said exposure to ionizing radiation.

15. A process in accordance with claim 9 comprising filtering said polymeric material through a wire screen of about 700 mesh.

16. A process in accordance with claim 9 in which said ionizing radiation is an electron beam from at least one accelerator.

* * * * *